United States Patent [19]

Dickinson, III

[11] Patent Number: 4,524,324

[45] Date of Patent: Jun. 18, 1985

[54] DOWNHOLE INSTRUMENT INCLUDING A FLEXIBLE PROBE WHICH CAN TRAVEL FREELY AROUND BENDS IN A BOREHOLE

[76] Inventor: Ben W. O. Dickinson, III, 2125 Broderick St., San Francisco, Calif. 94115

[21] Appl. No.: 461,768

[22] Filed: Jan. 28, 1983

Related U.S. Application Data

[63] Continuation-in-part of Ser. No. 347,304, Feb. 9, 1982.

[51] Int. Cl.[3] ..... G01V 3/18; E21B 47/00; E21B 29/02

[52] U.S. Cl. ..... 324/323; 33/304; 73/151; 166/250; 166/297; 174/52 PE; 250/256; 324/346; 324/347

[58] Field of Search ..... 324/219-221, 324/323, 333, 339, 346, 347, 355, 366, 67; 73/151, 152; 367/25, 911; 166/65 R, 65 M, 66, 297, 250, 259, 253, 254; 175/40, 50; 33/302, 304; 174/52 PE; 250/256

[56] References Cited

U.S. PATENT DOCUMENTS

| | | | |
|---|---|---|---|
| 1,803,057 | 4/1931 | Dyer . | |
| 3,020,471 | 2/1962 | Barringer | 324/330 X |
| 3,070,167 | 12/1962 | Loy et al. . | |
| 3,327,791 | 6/1967 | Harrigan . | |
| 3,330,880 | 7/1967 | Hutson et al. . | |
| 3,406,766 | 10/1968 | Henderson | 175/50 X |
| 3,975,735 | 8/1976 | McCullough | 324/67 X |
| 4,153,875 | 5/1979 | Pigeon et al. | 324/220 |
| 4,166,500 | 9/1979 | McPhee . | |
| 4,168,747 | 9/1979 | Youmans . | |
| 4,256,180 | 3/1981 | Mott . | |
| 4,279,304 | 7/1981 | Harper . | |
| 4,293,815 | 10/1981 | West et al. | 324/346 X |
| 4,323,848 | 4/1982 | Kuckes | 324/346 X |
| 4,413,231 | 11/1983 | Amedro et al. | 324/220 |

FOREIGN PATENT DOCUMENTS

| | | | |
|---|---|---|---|
| 2837488 | 12/1979 | Fed. Rep. of Germany | 324/219 |

*Primary Examiner*—Gerard R. Strecker

*Attorney, Agent, or Firm*—Flehr, Hohbach, Test, Albritton & Herbert

[57] ABSTRACT

Bore hole instrument and methods of manufacturing and using the same. The instrument includes an elongated flexible probe which is inserted into a bore hole and can travel freely around bends of relatively short radius in the hole. The probe includes a plurality of sensors, explosive charges or the like which are spaced apart and embedded in a flexible body comprising a mass of cushioning material, with a flexible outer casing of fabric having a high tensile strength. The probe is driven into a bore hole in piston-like fashion, and the flexible body enables the probe to travel freely around bends of relatively short radius. Instrumentation for processing signals from the probe is located at the surface of the earth, and a flexible cable interconnects the instrumentation with the probe.

17 Claims, 3 Drawing Figures

DOWNHOLE INSTRUMENT INCLUDING A FLEXIBLE PROBE WHICH CAN TRAVEL FREELY AROUND BENDS IN A BOREHOLE

This is a continuation-in-part of Ser. No. 347,304, filed Feb. 9, 1982.

This invention pertains generally to bore hole drilling and surveying, and more particularly to a downhole instrument and methods of manufacturing and using the same.

In the drilling of oil wells and other bore holes in the earth, it is at times necessary to determine the location of the drill or the precise location of the hole at a substantial distance below the surface of the earth. For this purpose, a surveying probe is inserted into the hole, and data from the probe is analyzed at the surface to determine the location of the probe. It is also desirable to determine the direction in which the drill is progressing and to control this direction.

In the downhole surveying equipment heretofore provided, the probe generally comprises an elongated, rigid body with an inflexible metal shell. Probes of this type are incapable of traveling around bends of relatively short radius (e.g., a 6–12 inch radius in a hole having a diameter on the order of $\frac{3}{4}$–1 inch), and therefore, they cannot be used in some holes.

Tools have also been provided for cutting and severing tubing, drill pipe and casing in a bore hole. Such tools generally have one or more remotely detonated explosive charges mounted in an elongated, rigid housing. Tools of this type are subject to the same limitations and disadvantages as the surveying and logging instruments heretofore provided in that they cannot travel around bends of relatively short radius and are not suitable for use in some holes.

It is in general an object of the invention to provide a new and improved downhole instrument and methods of manufacturing and using the same.

Another object of the invention is to provide an instrument and method of the above character which can also be utilized in the guidance of a downhole drill.

Another object of the invention is to provide an instrument and method of the above character which can be utilized in the cutting or severing of tubing, drill pipe and casing.

Another object of the invention is to provide an instrument and method of the above character which are suitable for use in holes having bends of relatively short radius.

Another object of the invention is to provide an instrument of the above character which is economical to manufacture.

These and other objects are achieved in accordance with the invention by providing an elongated flexible probe which is inserted into a bore hole and can travel freely around bends of relatively short radius in the hole.

The probe includes one or more sensors, explosive charges or the like which are spaced apart and embedded in a flexible body comprising a mass of cushioning material, with a flexible outer casing of fabric having a high tensile strength. The probe is driven into a bore hole in piston-like fashion by a pressurized fluid such as water or air, and the flexible body enables the probe to travel freely around bends of relatively short radius. Instrumentation for processing signals from the probe is located at the surface of the earth, and a flexible cable interconnects the instrumentation with the probe.

Figure 1:
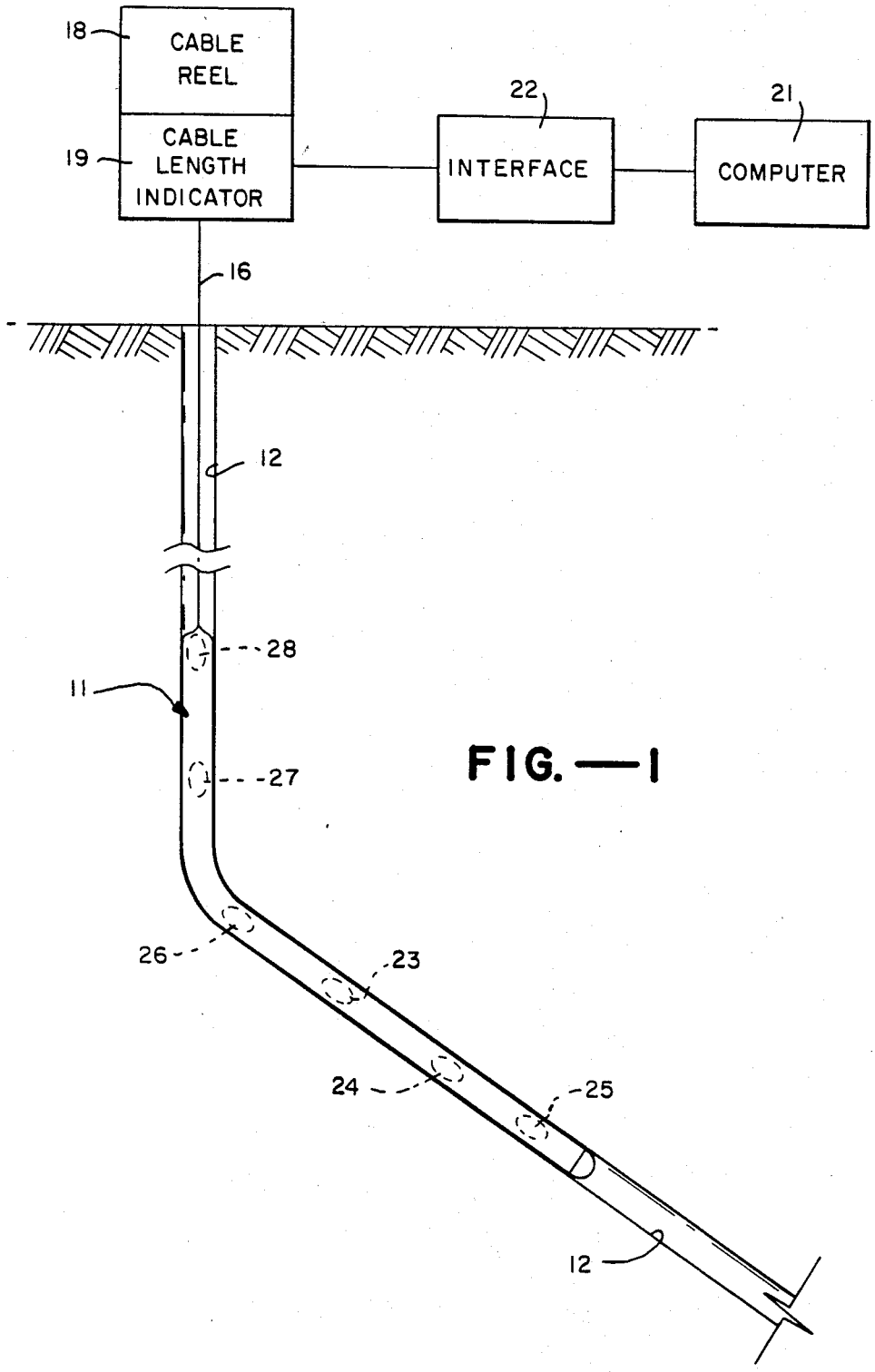
FIG. 1 is a schematic diagram of one embodiment of a bore hole surveying system incorporating the invention, with the flexible probe being inserted into a bore hole and passing around a bend.

As illustrated in FIG. 1, the surveying system includes an elongated, flexible probe 11 which is inserted into a hole 12 to be surveyed. The hole can be a bore hole in the earth, as illustrated, or any other elongated opening of limited diameter such as the opening in a pipe or tubing. The probe has a generally circular cross section, with an outer diameter slightly smaller than the inner diameter of the hole, e.g., for a hole diameter on the order of $\frac{3}{4}$–1 inch, the probe would have a diameter on the order of 0.70–0.95 inch. The length of the probe is substantially greater than the diameter, and a probe having a diameter of 0.70 inch could, for example, have a length on the order of 48 inches.

A flexible logging cable 16 extends in an axial direction from one end of the probe and carries electrical power and signals between the probe and equipment at the surface of the earth. This cable is of conventional design and has a plurality of flexible electrical conductors interleaved with a plurality of reinforcing strands of suitable material such as stainless steel. The cable is stored on a cable reel 18 at the surface of the earth, and the amount of cable fed into the hole is monitored by a cable length indicator 19 connected to the reel.

At the surface of the earth, the probe is interfaced with a microcomputer 21 by a suitable interface unit 22. The computer processes the signals from the probe and the cable depth indicator to determine the location and/or orientation of the hole in the region where the probe is located.

Figure 2:
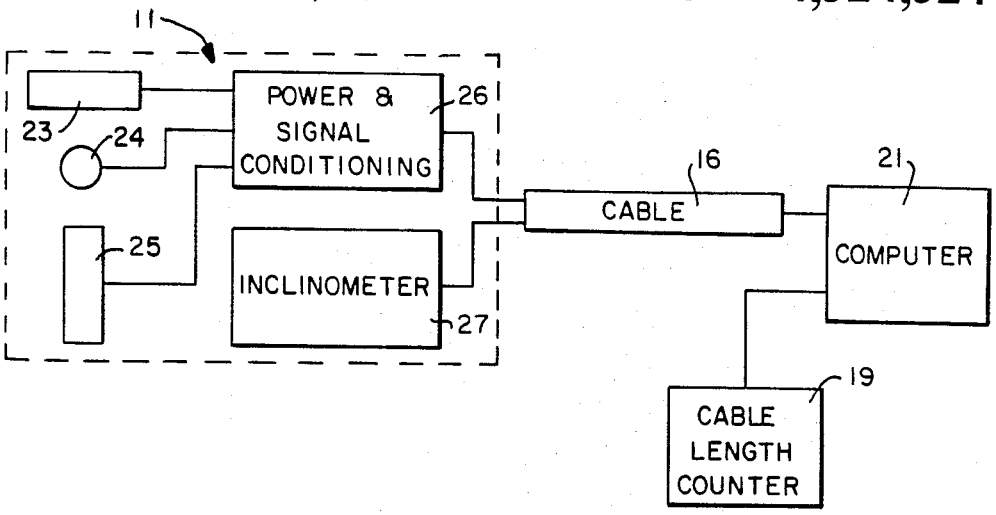
FIG. 2 is a block diagram of the surveying system of FIG. 1.

As illustrated in FIG. 2, probe 11 includes a payload such as three orientation sensors 23–25 which provide electrical signals corresponding to the orientations of the sensors relative to orthogonal reference axes. In this embodiment, the reference axis of sensor 23 is aligned with the axis of the probe, and the axes of sensors 24, 25 are aligned in perpendicular radial directions. Sensors 23–25 can be any suitable sensors of known design, including fluxgate compasses and other magnetometeres. As used herein, the term magnetometer includes any instrument capable of detecting natural or artificial flux lines, two common types of magnetometers being Hall effect devices and flux gate transformer systems. Other suitable sensors include gyroscopes and other inertial devices. Sensors 23–25 are connected to cable 16 through an electrical power and signal conditioning module 26 in the probe. The probe also includes an inclinometer 27 which provides a signal corresponding to the orientation of the probe about a pitch axis. If desired, additional inclinometers can be included to provide additional information such as the dip angle of the tool. Suitable inclinometers include accelerometers, electrolytic levels, and pendulous devices. Electrical connections between the cable, the power and signal conditioning module and the elements within the probe are made by a connector 28 of suitable known design.

Figure 3:
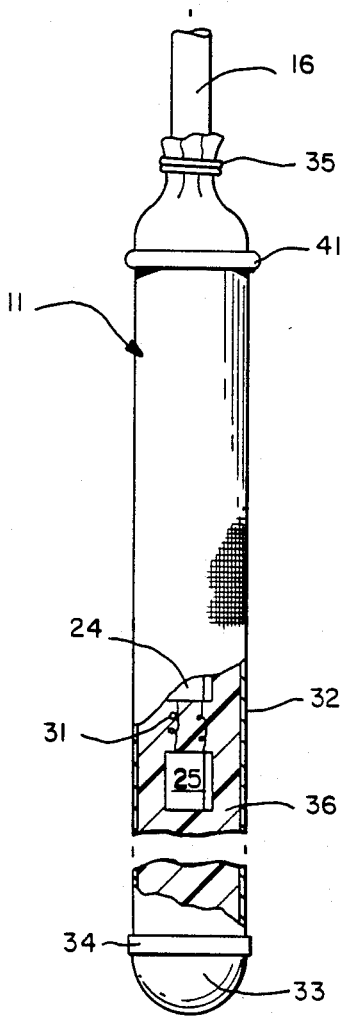
FIG. 3 is an enlarged sectional view, partly broken away, of the flexible probe of the embodiment of FIG. 1.

As illustrated in FIG. 3, sensors 23–25, module 26, inclinometer 27 and connector 28 are spaced apart along the axis of probe 11 and are innerconnected by flexible electrical conductors 31. Alternatively, the electrical components can be fabricated on a flexible circuit board, or on a board having a plurality of relatively short, rigid sections interconnected by one or more flexible sections. These elements are encased within an elongated, flexible casing 32 of high tensile strength. The casing is closed and secured to a stainless steel nose piece 33 by a clamp 34 at the distal end of the probe, and at the proximal end the casing is affixed by a clamp 35 to connector 28 and thus to logging cable 16.

In one presently preferred embodiment, casing 32 comprises a fabric woven or braided of fibers having a high tensile strength, i.e., a tensile strength greater than that of stainless steel, preferrably 250,000 lb/in$^2$ or more. One presently preferred fabric is an aromatic polyamide fiber manufactured by DuPont unde the trademark Kevlar. This fiber as a tensile strength on the order of 400,000 lb/in$^2$. Other suitable fibers of high tensile strength can also be employed, including graphite fibers, glass fibers, nylon fibers and boron fibers.

The interior of casing 32 is filled with a mass of flexible, electrically insulative material 36 which surrounds the sensors and other electrical components and provides cushioning for them. This material and the outer casing form a flexible body which can pass freely around bends of relatively short radius in the bore hole. Suitable materials include silicones and other synthetic rubber materials such as Devcon (trademark) polyurethane or a silicone rubber sold under the trademark Silastic. The flexible material can be either in a solid form or in a fluid form. Suitable fluid materials include silicones and fluorocarbons of high dielectric constant and low vapor pressure. The fluid can be in the form of a gel, and it preferably has a relatively high viscosity. One particularly suitable fluid material is a silane polymer known as Dow Corning 200 fluid. Alternatively, with a solid cushioning material, the fabric casing can be omitted, and axially extending fibers can be embedded in the mass of material to provide the desired tensile strentth, in which case it is desirable that the fibers be able to move axially within the mass of material to avoid collapsing of the body as it is bent.

The outer surface of casing 32 can be coated with a lubricious material such as polytetrafluoroethylene (Teflon) which facilitates the free passage of the probe through the bore hole. A flexible sealing ring 41 is affixed to the outer wall of the body toward the proximal end thereof to facilitate driving the probe through a bore hole, as discussed hereinafter. The outer diameter of the seal is chosen to provide sliding, sealing engagement with the inner wall of the opening in which the probe is to be used, and seals of different sizes and shapes can be mounted interchangeably for casings of different diameters. The seal can be bypassed with flow passageways (not shown) to prevent the formation of a vacuum behind the head of the probe as it is withdrawn from the hole.

In one presently preferred method of manufacture, the electrical components of the probe are connected together and suspended vertically from cable 16 in the desired spaced apart relationship. Casing 32 is positioned coaxially of these components, with the open end of the casing facing in an upward direction. The fluid silicone rubber material is then poured into the casing to form the flexible body. Connector 28 is installed and connected electrically to the leads in the probe and to the conductors of cable 16, the open end of the casing is drawn about the connector, and clamp 35 is installed.

With a solid cushioning material, the material can be formed about the electrical components in one or more successive layers, with adjacent ones of the layers being able to move somewhat relative to each other. The components and cushioning material are then inserted into the fabric casing as a unit.

In use, probe 11 is inserted into the upper portion of the hole to be surveyed or drilled, and pressurized fluid (e.g., water or air) is applied to the hole above the probe to drive the probe down through the hole in piston-like fashion, with seal 41 forming a seal between the body of the probe and the wall of the casing or other opening in which the probe is inserted. In the event that fluid is trapped in the hole ahead of the probe, it can be removed by any suitable means, e.g., by pumping it out of the hole, by withdrawing it from the hole by the cable, or by driving it into the formation surrounding the hole. When the probe reaches a bend in the hole, the body flexes, and the probe passes freely around the bend. As discussed above, the probe can travel around bends of relatively short radius, e.g., a bend having a radius of 6 inches in a hole having a diameter of $\frac{3}{4}$–1 inch. The probe is withdrawn from the hole by drawing on the logging cable.

Because of its relatively small diameter, probe 11 is also suitable for use in the guidance of a downhole drilling system. In this application, the probe is mounted in the drill motor housing itself or in a fluid passageway near the drill head, and cable 16 extends to the surface through the fluid passageway of another suitable passageway in the well casing. At the surface, the signals from the probe are processed and utilized to control the direction of the drill.

In addition to direction sensors, the payload or instrumentation within the probe can include other sensors for other logging functions, e.g., temperature, pressure, nuclear radiation, hydrogen ion concentration, and instruments for measuring the characteristics of the formation being drilled.

The invention is also useful in tools for cutting or severing drill pipes, tubing and/or casing in a bore hole. A tool of this type made in accordance with the invention is similar to the instrument of FIGS. 1 and 3, with electrically detonated explosive charges instead of sensors 23–25. The explosives can be any suitable explosives of known composition, e.g., pellets or plastic explosives, such as C3 or RDX. Electrical detonating signals are applied to the explosives by cable 16 and the electrical leads within the probe. The charges can be arranged to provide any type of cutting action required, e.g., a concentrated explosion for severing a drill head from the end of a tube, or a series of explosions for perforating a line as the probe passes through it.

It is apparent from the foregoing that a new and improved downhole probe and methods of manufacturing and using the same have been provided. While only certain presently preferred embodiments have been described in detail, as will be apparent to those familiar with the art, certain changes and modifications can be made without departing from the scope of the invention as defined by the following claims.

I claim:

1. In a package for use in a bore hole in the earth: an axially elongated flexible fabric casing of high tensile strength, payload within the casing for providing or receiving electrical signals, an elongated mass of flexible, cushioning material surrounding the payload and filling the casing to form flexible body which can be propelled through the bore hole in piston-like fashion by pressurized fluid and can travel around bends of relatively short radius in the bore hole, and a flexible cable extending axially from one end of the body and being secured to the casing of flexible material and connected electrically to the payload for carrying signals between the payload and the surface of the earth.

2. The package of claim 1 wherein the payload comprises a plurality of sensors spaced axially within the flexible body for providing electrical information signals.

3. The package of claim 1 wherein the payload comprises an explosive detonated by signals applied to the cable.

4. The pacakge of claim 1 wherein the casing is fabricated of a fabric comprising fibers selected from the group consisting of aromatic polyamide fibers, glass fibers, graphite fibers, boron fibers, nylon fibers, and combinations thereof.

5. The package of claim 1 wherein the cushioning material comprises a silicone rubber.

6. The package of claim 1 wherein the cushioning material is in a fluid state.

7. The package of claim 1 wherein the outer surface of the casing is coated with a lubricious material.

8. In an instrument for use in a bore hole in the earth: a plurality of sensors spaced apart along an axis for providing electrical information signals, an axially extending flexible cable for carrying signals between the sensors and the surface of the earth, a plurality of flexible electrical conductors interconnecting the sensors and the cable, an axially elongated flexible fabric casing of high tensile strength surrounding the sensors and the electrical conductors and being affixed to the flexible cable toward one end thereof, and a mass of flexible, electrically insulative, cushioning material surrounding the sensors and the electrical conductors within the casing to form a flexible probe capable of travelling around bends of relatively short radius in the bore hole.

9. The instrument of claim 8 wherein at least one of the sensors is selected from the group consisting of magnetometers, accelerometers, gyroscopes and inertial devices.

10. The instrument of claim 8 wherein the casing is fabricated of an aromatic polyamide fabric.

11. The instrument of claim 8 wherein the casing is fabricated of a fabric comprising fibers selected from the group consisting of aromatic polyamide fibers, glass fibers, graphite fibers, boron fibers, nylon fibers, and combinations thereof.

12. The instrument of claim 8 wherein the electrically insulative cushioning material comprises a silicone rubber.

13. The instrument of claim 8 wherein the electrically insulative cushioning material is in a fluid state.

14. The instrument of claim 8 wherein the outer surface of the casing is coated with a lubricious material.

15. In apparatus for obtaining information from a bore hole in the earth: an elongated flexible probe which is inserted into the hole and can travel freely around bends of relatively short radius in the hole, said probe having a body formed of a flexible mass of electrically insulative cushioning material and a flexible fabric casing of high tensile strength enveloping the flexible mass, means carried by the body and surrounded by the cushioning material for providing signals corresponding to the information to be obtained, instrumentation means located at the surface of the earth for processing the probe signals, and a flexible connecting cable affixed to the probe and electrically connected to the instrumentation means.

16. The apparatus of claim 15 wherein the flexible means of cushioning material is a fluid.

17. The apparatus of claim 15 including a flexible sealing ring projecting laterally from the probe for sliding engagement with the inner wall of the hole into which the probe is inserted.

* * * * *